US010427898B2

(12) United States Patent
Park et al.

(10) Patent No.: US 10,427,898 B2
(45) Date of Patent: Oct. 1, 2019

(54) SHEET TRANSFER APPARATUS AND METHOD FOR TRANSFERRING SHEET USING THE SAME

(71) Applicant: Samsung Display Co., Ltd., Yongin-si, Gyeonggi-do (KR)

(72) Inventors: Gyuwon Park, Cheonan-si (KR); Hoeoun Kim, Hwaseong-si (KR); Jungsoo Ok, Asan-si (KR); Pilseon Ji, Cheongju-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/004,003

(22) Filed: Jun. 8, 2018

(65) Prior Publication Data

US 2019/0092590 A1 Mar. 28, 2019

(30) Foreign Application Priority Data

Sep. 27, 2017 (KR) ..... 10-2017-0125554

(51) Int. Cl.
*B65H 3/08* (2006.01)

(52) U.S. Cl.
CPC ..... *B65H 3/0816* (2013.01); *B65H 2406/12* (2013.01); *B65H 2406/34* (2013.01); *B65H 2406/351* (2013.01)

(58) Field of Classification Search
CPC ... B65H 1/00; B65H 1/04; B65H 3/00; B65H 3/08; B65H 3/0816; B65H 3/0833; B65H 3/0841; B65H 3/48; B65H 11/00; B65H 2406/12; B65H 2406/34; B65H 2406/342; B65H 2406/351; B65H 2701/193
USPC ..... 271/90, 98, 104; 156/569, 570
See application file for complete search history.

(56) References Cited

U.S. PATENT DOCUMENTS

2006/0286769 A1* 12/2006 Tsuchiya ..... B65H 3/0816 438/458
2009/0008864 A1* 1/2009 Maruyama ..... B65G 59/045 271/98
2017/0341884 A1* 11/2017 Takanaga ..... B65H 3/047

FOREIGN PATENT DOCUMENTS

KR 10-2012-0067117 A 6/2012
KR 10-1462598 B1 11/2014
KR 10-2015-0068575 A 6/2015
KR 10-1689119 B1 12/2016
KR 10-1711428 B1 3/2017

* cited by examiner

*Primary Examiner* — Prasad V Gokhale
(74) *Attorney, Agent, or Firm* — Lewis Roca Rothgerber Christie LLP

(57) ABSTRACT

A sheet transfer apparatus and a method for transferring a sheet using a sheet transfer apparatus are provided. A sheet transfer apparatus includes: a table on which two or more sheets, which are continuously laminated, are configured to be seated; a sheet adsorbing part on the table to adsorb a first sheet, which is at an uppermost portion, of the two or more laminated sheets at a pressure; and an air discharge part on the table and adjacent to the sheet adsorbing part, and the air discharge part is configured to discharge air to a surface of the first sheet adsorbed to the sheet adsorbing part.

17 Claims, 17 Drawing Sheets

SHEET TRANSFER APPARATUS AND METHOD FOR TRANSFERRING SHEET USING THE SAME

CROSS-REFERENCE TO RELATED APPLICATION

This application claims priority to and the benefit of Korean Patent Application No. 10-2017-0125554, filed on Sep. 27, 2017 in the Korean Intellectual Property Office, the entire content of which is hereby incorporated by reference.

BACKGROUND

1. Field

Aspects of embodiments of the present disclosure relate to a sheet transfer apparatus and a method for transferring a sheet using the same.

2. Description of the Related Art

In general, when electronic devices are manufactured, masks having openings in various shapes are used to form various patterns. For example, when an organic light emitting display device is manufactured, it is necessary to deposit an organic material on only a preset area. For this, the deposition is performed by using a mask having openings corresponding to the preset area. Thus, it is necessary to manufacture a mask having the above-described openings. The mask may be manufactured in a manner in which a laser beam is irradiated onto a preset area of, for example, a metal thin plate to form openings. In the process of manufacturing the mask, a quality pre-inspection may be carried out on the metal thin plate that is a raw material of the mask.

Before the quality pre-inspection of the mask and the manufacturing process, an inspection of a metal stick that is a raw material of the mask is performed, and a process of transferring the metal stick up to a manufacturing process line is performed. Here, a plurality of protection sheets are laminated on the metal stick to protect the metal stick, and it is necessary to transfer the protection sheets and the metal stick between the inspection process and the transfer process by using various devices.

SUMMARY

According to aspects of embodiments of the present disclosure, a sheet transfer apparatus capable of continuously transferring multilayer-laminated sheets and a method for transferring sheets using the same are provided.

According to another aspect of embodiments of the present disclosure, a method for transferring a sheet is provided, in which an occurrence of defects of an object to be transferred is suppressed during a transfer process, and the transfer process is continuously performed to reduce a process time and cost.

According to one or more embodiments of the inventive concept, a sheet transfer apparatus includes: a table on which two or more sheets, which are continuously laminated, are configured to be seated; a sheet adsorbing part on the table to adsorb a first sheet, which is at an uppermost portion, of the two or more laminated sheets at a pressure; and an air discharge part on the table and adjacent to the sheet adsorbing part, and the air discharge part is configured to discharge air to a surface of the first sheet adsorbed to the sheet adsorbing part.

In an embodiment, the sheet transfer apparatus may further include an elevation unit configured to vertically elevate the sheet adsorbing part and the air discharge part, and the elevation unit may include: a support part having a long side extending in a first direction and a short side extending in a second direction crossing the first direction; and an elevation part configured to vertically elevate the support part.

In an embodiment, the sheet adsorbing part may include a first sheet adsorbing part and a second sheet adsorbing part, which are connected to the support part, spaced apart from each other in the first direction, and respectively arranged on outer portions of the support part in a long side direction.

In an embodiment, the air discharge part may include: first and second air discharge parts arranged in parallel with the first sheet adsorbing part therebetween in the second direction; and third and fourth air discharge parts arranged in parallel with the second sheet adsorbing part therebetween in the second direction.

In an embodiment, a metal stick may be configured to be further seated on the table, and the metal stick on the table, the second sheet on the metal stick, and the first sheet on the second sheet may be sequentially laminated.

In an embodiment, the sheet transfer apparatus may further include a stick adsorbing part configured to adsorb the metal stick and arranged on an inner portion the support part in a long side direction.

In an embodiment, the stick adsorbing part may include a first stick adsorbing part and a second stick adsorbing part, which are spaced apart from each other.

In an embodiment, the sheet transfer apparatus may further include an auxiliary air discharge part adjacent to the stick adsorbing part, and the auxiliary air discharge part may include: fifth and sixth air discharge parts arranged in parallel with the first stick adsorbing part therebetween in the second direction; and seventh and eighth air discharge parts arranged in parallel with the second stick adsorbing part therebetween in the second direction.

In an embodiment, the sheet adsorbing part and the stick adsorbing part may be spaced from each other by a distance of about 25 cm to about 30 cm.

In an embodiment, the sheet adsorbing part and the air discharge part may be spaced from each other by a distance of about 40 mm to about 60 mm.

According to one or more embodiments of the inventive concept, a method for transferring a sheet includes: continuously laminating two or more sheets on a table; and transferring a first sheet, which is at an uppermost portion, of the two or more laminated sheets, and the transferring of the first sheet includes: adsorbing the first sheet of the two or more laminated sheets at a first pressure through a sheet adsorbing part; elevating the first sheet at a reference height; and discharging air to a surface of the first sheet through an air discharge part arranged adjacent to the sheet adsorbing part to separate a second sheet of the two or more sheets that ascends together with the adsorbed first sheet.

In an embodiment, the method may further include, before the laminating of the sheets, seating a metal stick on the table, wherein the metal stick, the second sheet, and the first sheet may be sequentially laminated on the table.

In an embodiment, the method may further include, after the transferring of the first sheet: adsorbing the second sheet at the first pressure through the sheet adsorbing part to elevate and transfer the second sheet; and adsorbing the metal stick at a second pressure less than the first pressure through a stick adsorbing part spaced apart from the sheet adsorbing part to elevate and transfer the metal stick.

In an embodiment, the sheet adsorbing part may include a first sheet adsorbing part and a second sheet adsorbing part, which are spaced apart from each other in a first direction, and the stick adsorbing part may include a first stick adsorbing part and a second stick adsorbing part, which are between the first sheet adsorbing part and the second sheet adsorbing part.

In an embodiment, the air discharge part may include: a first air discharge part adjacent to the first sheet adsorbing part and the first stick adsorbing part; a second air discharge part adjacent to the first sheet adsorbing part and the first stick adsorbing part and in parallel to the first air discharge part in a second direction; a third air discharge part adjacent to the second sheet adsorbing part and the second stick adsorbing part and in parallel to the first air discharge part in the first direction; and a fourth air discharge part adjacent to the second sheet adsorbing part and the second stick adsorbing part and in parallel to the second air discharge part in the first direction.

In an embodiment, the separating of the second sheet may include: discharging air through the first air discharge part and the fourth air discharge part; and discharging air through the second air discharge part and the third air discharge part, and the discharging of the air through the first air discharge part and the fourth air discharge part and the discharging of the air through the second air discharge part and the third air discharge part may be alternately repeatedly performed.

In an embodiment, the discharging of the air through the first air discharge part and the fourth air discharge part and the discharging of the air through the second air discharge part and the third air discharge part may be alternately repeatedly performed about 10 times to about 20 times.

In an embodiment, the separating of the second sheet may be performed when the first sheet ascends to a height of about 20 mm to about 35 mm.

BRIEF DESCRIPTION OF THE FIGURES

The accompanying drawings are included to provide a further understanding of the inventive concept, and are incorporated in and constitute a part of this specification. The drawings illustrate some exemplary embodiments of the inventive concept and, together with the description, serve to explain principles of the inventive concept. In the drawings.

DETAILED DESCRIPTION

Figure 1:
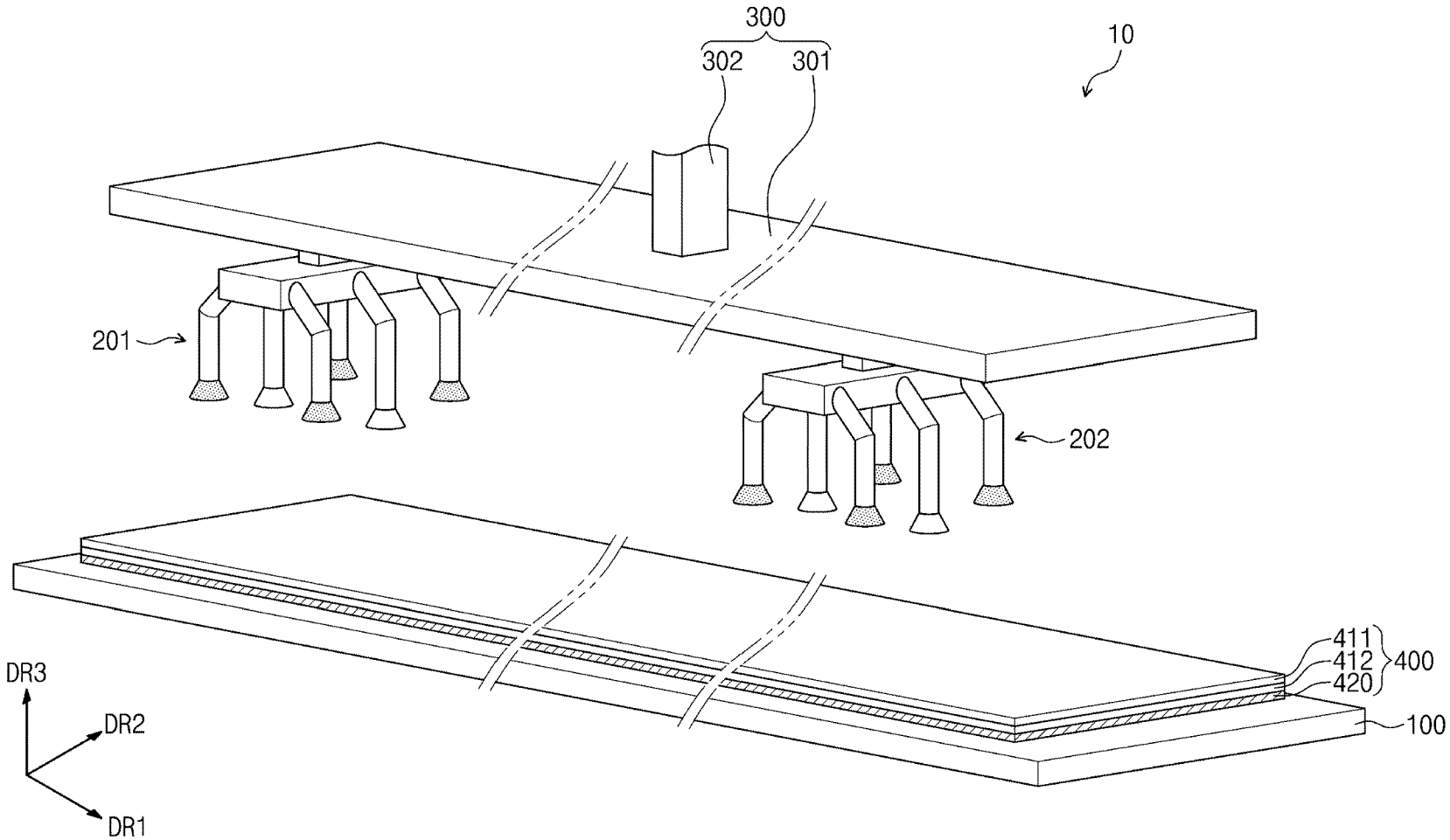
FIG. 1 is a perspective view of a sheet transfer apparatus according to an embodiment of the inventive concept.

Herein, some embodiments of the inventive concept will be described with reference to the accompanying drawings. In this specification, it is to be understood that when a component (or a region, layer, or portion) is referred to as being "on," "connected to," or "coupled to" another component, it can be directly connected or coupled on or onto the component, or one or more intervening third components may also be present.

Like reference numerals refer to like elements throughout. Also, in the figures, the thicknesses, ratios, and dimensions of components may be exaggerated for clarity of illustration. The term "and/or" includes any and all combinations of one or more of the associated listed items.

It is to be understood that although terms such as "first" and "second" are used herein to describe various elements, these elements should not be limited by these terms. The terms are used to distinguish one component from other components. For example, a first element referred to as a "first" element in one embodiment can be referred to as a "second" element in another embodiment without departing from the scope of the appended claims. The terms of a singular form may include plural forms unless referred to the contrary.

Also, terms such as "under," "below," "above," "upper," and the like are used for explaining relation association of components illustrated in the drawings. The terms may be a relative concept and described based on directions expressed in the drawings.

The meaning of "include" or "comprise" specifies a property, a fixed number, a step, an operation, an element, a component, or a combination thereof, but does not exclude other properties, fixed numbers, steps, operations, elements, components, or combinations thereof.

Herein, some exemplary embodiments of the inventive concept will be described below in more detail with reference to the accompanying drawings. Herein, a sheet transfer apparatus according to an embodiment of the inventive concept will be described.

Figure 2:
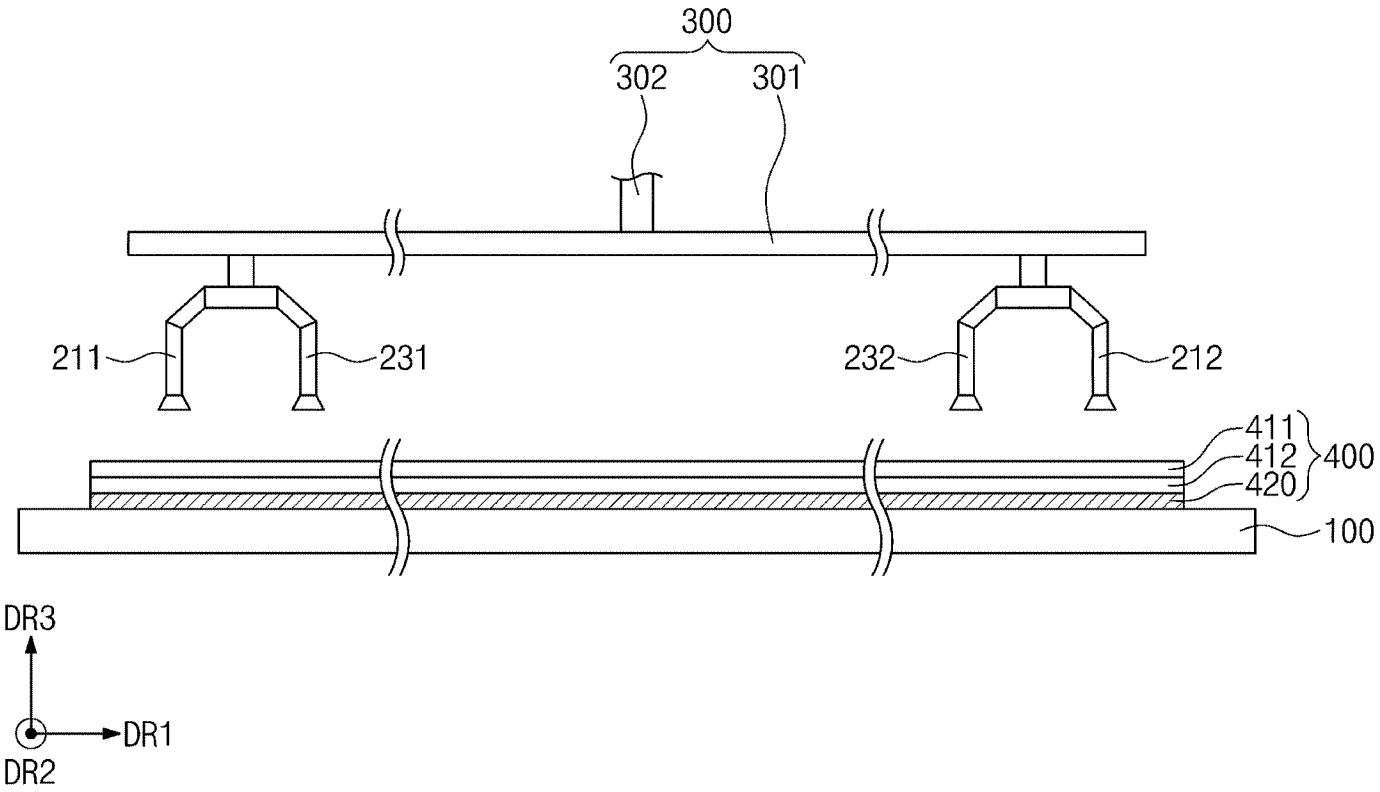
FIG. 2 is a cross-sectional view of the sheet transfer apparatus according to an embodiment of the inventive concept.
Figure 3:
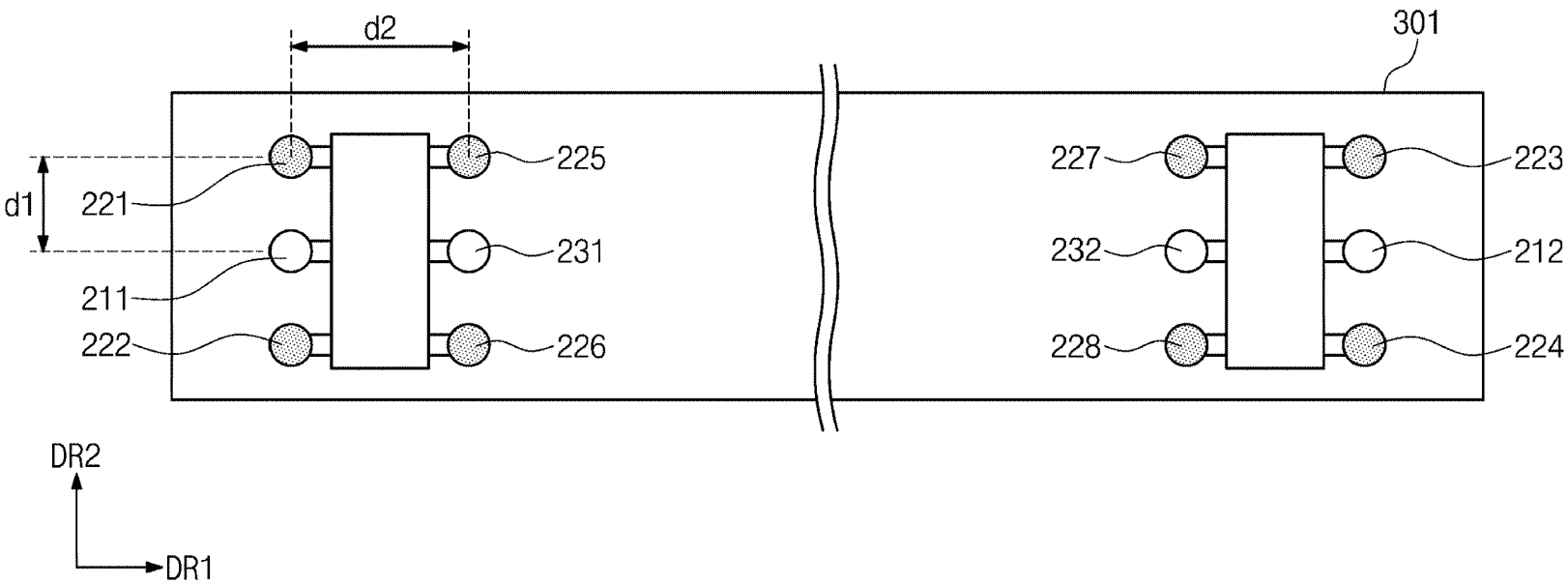
FIG. 3 is a plan view of the sheet transfer apparatus when viewed from a lower side according to an embodiment of the inventive concept.

FIG. 1 is a perspective view of a sheet transfer apparatus according to an embodiment of the inventive concept; FIG. 2 is a cross-sectional view of the sheet transfer apparatus according to an embodiment of the inventive concept; and FIG. 3 is a plan view of the sheet transfer apparatus when viewed from a lower side according to an embodiment of the inventive concept. Herein, a sheet transfer apparatus according to an embodiment of the inventive concept will be described with reference to FIGS. 1 to 3.

Referring to FIG. 1, a sheet transfer apparatus 10 according to an embodiment of the inventive concept includes a table 100 and adsorbing and releasing units 201 and 202.

An object 400 to be transferred (herein, referred to as a transferred object) is seated on the table 100 by the sheet transfer apparatus 10 according to an embodiment of the inventive concept. Two or more sheets that are continuously laminated are seated on the table 100. For example, as illustrated in FIG. 1, a first sheet 411 and a second sheet 412 may be continuously laminated and seated on the table 100. However, an embodiment of the inventive concept is not limited thereto. For example, three or more sheets may be continuously laminated and seated on the table 100.

A metal stick 420 may be further seated on the table 100. The metal stick 420 may be disposed below the sheets 411 and 412, which are continuously laminated, on the table 100. In an embodiment, the metal stick 420, the second sheet 412, and the first sheet 411 are successively laminated and seated on the table 100.

In an embodiment, each of the sheets 411 and 412 disposed on the table 100 may be a flexible paper having a thin thickness. In an embodiment, the sheets 411 and 412 disposed on the table 100 may be packing papers disposed to protect the metal stick 420 disposed therebelow. In an embodiment, the sheets 411 and 412 disposed on the table 100 may be packing papers for protecting, which are coated with a chemical material.

In an embodiment, the transferred object, which is seated on the table 100, may have a rectangular shape on a plane. On the plane, the transferred object 400 may have a rectangular shape having a long side in a first direction DR1 and a short side in a second direction DR2 crossing the first direction DR1. In an embodiment, as illustrated in FIG. 1, each of the first sheet 411, the second sheet 412, and the metal stick 420, which are seated on the table 100, may have a rectangular shape having a long side in the first direction DR1 and a short side in the second direction DR2 on the plane. However, embodiments of the inventive concept are not limited thereto. For example, the transferred object 400 may have any of various shapes.

The adsorbing and releasing units 201 and 202 are disposed on the table 100. The adsorbing and releasing units 201 and 202 may be provided in plurality. In an embodiment, as illustrated in FIG. 1, the adsorbing and releasing units 201 and 202 may include a first adsorbing and releasing unit 201 and a second adsorbing and releasing unit 202. When the transferred object 400 has the rectangular shape, that is, when the first sheet 411 seated on the table 100 has the rectangular shape, the first adsorbing and releasing unit 201 and the second adsorbing and releasing unit 202 may be disposed at ends of the first sheet 411 in a long side direction. The first adsorbing and releasing unit 201 and the second adsorbing and releasing unit 202 may be spaced apart from each other in the first direction DR1 that is an extending direction of the long side of the first sheet 411 and may be respectively disposed adjacent to the short sides of the first sheet 411.

The sheet transfer apparatus 10 according to an embodiment of the inventive concept may further include an elevation unit 300 connected to the adsorbing and releasing units 201 and 202. The elevation unit 300 may include a support part 301 and an elevation part 302. The elevation unit 300 may be a device for vertically elevating the adsorbing and releasing units 201 and 202.

The support part 301 may have a shape on a plane, which corresponds to the shape of the transferred object 400 seated on the table 100 on the plane. In an embodiment, as illustrated in FIG. 1, the support part 301 may have a rectangular shape having a long axis extending in the first direction DR1 and a short axis extending in the second direction DR2. The first adsorbing and releasing unit 201 and the second adsorbing and releasing unit 202 may be connected to the support part 301. The first adsorbing and releasing unit 201 and the second adsorbing and releasing unit 202 may be connected to both ends of the support part 301 in a long axis direction, respectively. The first adsorbing and releasing unit 201 and the second adsorbing and releasing unit 202 may be connected to be adjacent to the short axes of the support part 301, respectively.

The elevation part 302 may be a part disposed on the support part 301 to vertically elevate the support part 301. The elevation part 302 may be a part for vertically elevating the first adsorbing and releasing unit 201 and the second adsorbing and releasing unit 202, which are connected to the support part 301.

Referring to FIGS. 1 to 3, each of the first adsorbing and releasing unit 201 and the second adsorbing and releasing unit 202 may include a sheet adsorbing part and an air discharge part. The first adsorbing and releasing unit 201 may include a first sheet adsorbing part 211. The second adsorbing and releasing unit 202 may include a second sheet adsorbing part 212.

The first sheet adsorbing part 211 and the second sheet adsorbing part 212 may be disposed to be spaced apart from each other in the first direction DR1. The first sheet adsorbing part 211 and the second sheet adsorbing part 212 may be disposed on outer portions of the support part 301 in the long axis direction, respectively. In an embodiment, the first sheet adsorbing part 211 and the second sheet adsorbing part 212 may be disposed on the outermost portions of the support part 301 in the long axis direction, respectively.

The first adsorbing and releasing unit 201 may include a first air discharge part 221 and a second air discharge part 222. The first air discharge part 221 and the second air discharge part 222 may be disposed in parallel with the first sheet adsorbing part 211 therebetween in the second direction DR2. In an embodiment, the first sheet adsorbing part 211, the first air discharge part 221, and the second air discharge part 222 may be disposed in parallel in the second direction DR2.

The second adsorbing and releasing unit 202 may include a third air discharge part 223 and a fourth air discharge part 224. The third air discharge part 223 and the fourth air discharge part 224 may be disposed in parallel with the second sheet adsorbing part 212 therebetween in the second direction DR2. In an embodiment, the second sheet adsorbing part 212, the third air discharge part 223, and the fourth air discharge part 224 may be disposed in parallel in the second direction DR2.

The air discharge parts are disposed adjacent to the sheet adsorbing parts. In an embodiment, the first air discharge part 221 and the second air discharge part 222 may be disposed adjacent to the first sheet adsorbing part 211, and the third air discharge part 223 and the fourth air discharge part 224 may be disposed adjacent to the second sheet adsorbing part 212.

Each of the first adsorbing and releasing unit 201 and the second adsorbing and releasing unit 202 may further include a stick adsorbing part. The first adsorbing and releasing unit 201 may include a first stick adsorbing part 231. The second adsorbing and releasing unit 202 may include a second stick adsorbing part 232.

The first stick adsorbing part 231 and the second stick adsorbing part 232 may be disposed to be spaced apart from each other in the first direction DR1. The first stick adsorbing part 231 and the second stick adsorbing part 232 may be connected to the support part 301 and disposed on inner portions of the support part 301 in the long axis direction rather than the sheet adsorbing parts. The first stick adsorbing part 231 may be disposed on the inner portion of the support part 301 in the long axis direction rather than the first sheet adsorbing part 211, and the second stick adsorbing part 232 may be disposed on the inner portion of the support part 301 in the long axis direction rather than the second sheet adsorbing part 212. That is, a distance between the first sheet adsorbing part 211 and the second sheet adsorbing part 212 may be greater than a distance between the first stick adsorbing part 231 and the second stick adsorbing part 232 in the first direction DR1.

The sheet transfer apparatus 10 according to an embodiment of the inventive concept may further include an auxiliary air discharge part disposed adjacent to the stick adsorbing part. In an embodiment, the first adsorbing and releasing unit 201 may include a fifth air discharge part 225 and a sixth air discharge part 226, which are disposed adjacent to the first stick adsorbing part 231, and the second adsorbing and releasing unit 202 may include a seventh air discharge part 227 and an eighth air discharge part 228, which are disposed adjacent to the second stick adsorbing part 232.

The fifth air discharge part 225 and the sixth air discharge part 226 may be disposed in parallel with the first stick adsorbing part 231 therebetween in the second direction DR2. In an embodiment, the first sheet adsorbing part 231, the fifth air discharge part 225, and the sixth air discharge part 226 may be disposed in parallel in the second direction DR2.

The seventh air discharge part 227 and the eighth air discharge part 228 may be disposed in parallel with the second stick adsorbing part 232 therebetween in the second direction DR2. In an embodiment, the second sheet adsorbing part 232, the seventh air discharge part 227, and the eighth air discharge part 228 may be disposed in parallel in the second direction DR2.

In the sheet transfer apparatus 10 according to an embodiment of the inventive concept, the air discharge part may be disposed adjacent to the sheet adsorbing part, and the auxiliary air discharge part may be disposed adjacent to the stick adsorbing part. In this specification, the term "disposed adjacent to" may represent that two parts are disposed at a small distance of about 70 mm or less therebetween. In an embodiment, the air discharge part may be disposed to be spaced a distance of about 40 mm to about 60 mm from the sheet adsorbing part, and the auxiliary air discharge part may be disposed to be spaced a distance of about 40 mm to about 60 mm from the stick adsorbing part. For example, referring to FIG. 3, the first sheet adsorbing part 211 and the first air discharge part 221 may have a distance d1 of about 40 mm to about 60 mm therebetween.

In the sheet transfer apparatus 10 according to an embodiment of the inventive concept, the sheet adsorbing part and the stick adsorbing part may be disposed to be spaced apart from each other. The stick adsorbing part may be spaced apart from the sheet adsorbing part and may be connected to a portion of the support part 301, which corresponds inside the sheet adsorbing part, in the long axis direction. In an embodiment, the sheet adsorbing part and the stick adsorbing part may be disposed to be spaced a distance of about 20 cm from each other. In an embodiment, the sheet adsorbing part and the stick adsorbing part may be disposed to be spaced a distance of about 25 cm to about 30 cm from each other. For example, referring to FIG. 3, the first sheet adsorbing part 211 and the first stick adsorbing part 231 may be disposed to be spaced a distance d2 of about 25 cm to about 30 cm from each other.

Figure 4A:
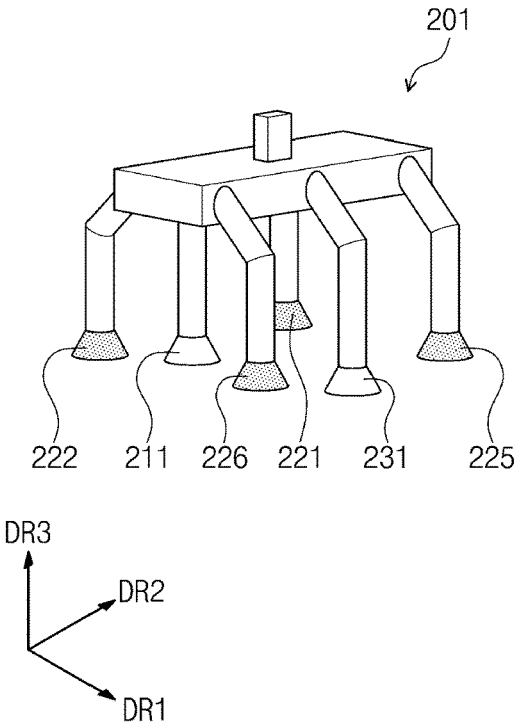
FIG. 4A is a perspective view illustrating a portion of the sheet transfer apparatus according to an embodiment of the inventive concept.
Figure 4B:
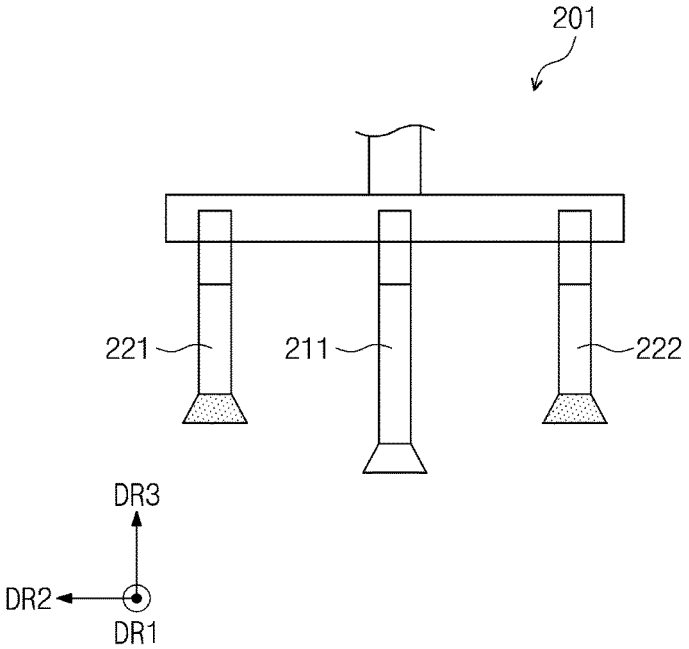
FIG. 4B is a side view illustrating a portion of the constituents of FIG. 4A.

FIG. 4A is a perspective view illustrating a portion of the sheet transfer apparatus according to an embodiment of the inventive concept. FIG. 4B is a side view illustrating a portion of the constituents of FIG. 4A. FIGS. 4A and 4B illustrate the first adsorbing and releasing unit 201 provided in the sheet transfer apparatus according to an embodiment of the inventive concept. Herein, the first adsorbing and releasing unit 201 according to an embodiment of the inventive concept will be described with reference to FIGS. 4A and 4B. Although only the first adsorbing and releasing unit 201 is shown in FIGS. 4A and 4B, the following description with respect to FIGS. 4A and 4B may also be applied to the second adsorbing and releasing unit 202. The same reference numerals may be given to components that are the same as those of FIGS. 1 to 3, and their further description will be omitted.

Referring to FIGS. 4A and 4B, the first adsorbing and releasing unit 201 includes a sheet adsorbing part, a stick adsorbing part, a plurality of air discharge parts, and a plurality of auxiliary air discharge parts. In an embodiment, the first adsorbing and releasing unit 201 may include a first sheet adsorbing part 211, a first stick adsorbing part 231, a first air discharge part 221, a second air discharge part 222, a fifth air discharge part 225, and a sixth air discharge part 226.

Each of the air discharge part and the auxiliary air discharge part may have a length, which extends toward the table (see reference 100 of FIG. 1), less than that of each of the sheet adsorbing part and the stick adsorbing part. In an embodiment, each of the air discharge part and the auxiliary air discharge part may have a shorter length, which extends in a third direction DR3 crossing the first direction DR1 and the second direction DR2, than that of each of the sheet adsorbing part and the stick adsorbing part. Referring to FIGS. 4A and 4B, each of the first air discharge part 221, the second air discharge part 222, the fifth air discharge part 225, and the sixth air discharge part 226 may have a shorter length, which extends in the third direction DR3, than that of each of the first sheet adsorbing part 211 and the first stick adsorbing part 231.

In the sheet transfer apparatus according to an embodiment of the inventive concept, each of the air discharge part and the auxiliary air discharge part may have a shorter length, which extends toward the table, than that of the sheet adsorbing part. Thus, when the uppermost sheet that is the transferred object is adsorbed by the sheet adsorbing part, the air discharge part and the auxiliary air discharge part may be spaced by a distance (e.g., a predetermined distance) from each other without coming into contact with the sheet. Thus, when air is discharged to a surface of the adsorbed sheet by the air discharge part and the auxiliary air discharge part, the air may be discharged to generate vibration on the sheet without physically damaging the adsorbed sheet.

Figure 5:
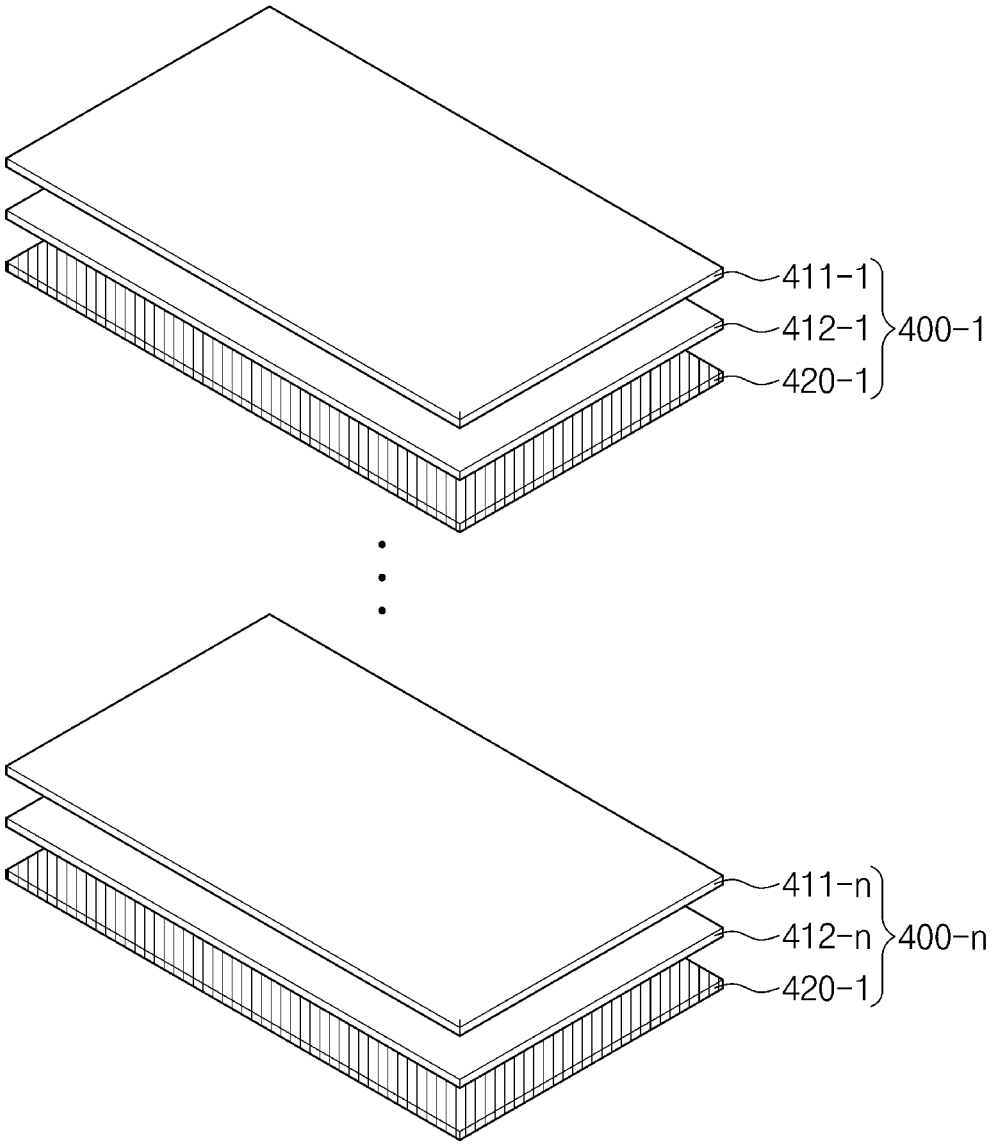
FIG. 5 is a perspective view illustrating a laminated structure of an object to be transferred in the sheet transfer apparatus according to an embodiment of the inventive concept.

FIG. 5 is a perspective view illustrating a laminated structure of an object to be transferred in the sheet transfer apparatus according to an embodiment of the inventive concept. Herein, a laminated structure of a transferred object that is transferred by the sheet transfer apparatus according to an embodiment of the inventive concept will be described with reference to FIG. 5.

Referring to FIG. 5, the transferred object that is transferred by the sheet transfer apparatus according to an embodiment of the inventive concept may have a structure in which a plurality of sheets and metal sticks are laminated. The transferred object transferred by the sheet transfer apparatus according to an embodiment of the inventive concept may have a structure in which a plurality of sheet-metal stick laminates, each of which has a structure in which two sheets of sheets and metal sticks are laminated, are laminated.

The transferred object transferred by the sheet transfer apparatus according to an embodiment of the inventive concept may include a sheet-metal stick laminate 400-1 in which a first sheet 411-1, a second sheet 412-1, and a metal stick 420-1 are sequentially laminated. Although one unit of the sheet-metal stick laminate is disposed on the table (see reference numeral 100 of FIG. 1) in FIGS. 1 and 2, embodiments of the inventive concept are not limited thereto. For example, a plurality of sheet-metal stick laminates may be disposed on the table 100. As illustrated in FIG. 5, the sheet-metal stick laminates 400-1 and **400-*n* may have a structure in which a plurality of units of the sheet-metal stick laminate are sequentially laminated. In an embodiment, the sheet-metal stick laminates 400-1 and 400-*n*** may have a structure in which two to ten units are sequentially laminated (where n is an integer of 2 to 10).

Herein, a method for transferring a sheet by using a sheet transfer apparatus according to an embodiment of the inventive concept will be described. The same reference numeral may be given to components that are the same as those of the sheet transfer apparatus according to the above-described embodiment of the inventive concept, and further description thereof will be omitted.

Figure 6:
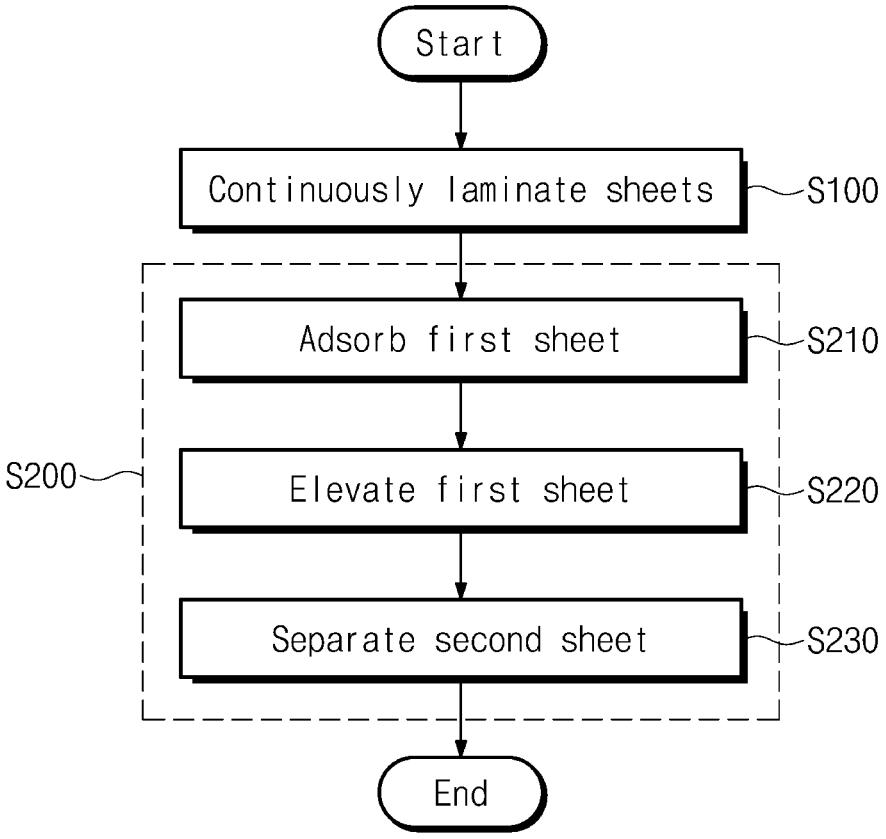
FIG. 6 is a flowchart sequentially illustrating a method for transferring a sheet according to an embodiment of the inventive concept.

FIG. 6 is a flowchart sequentially illustrating a method for transferring a sheet according to an embodiment of the inventive concept. FIGS. 7A to 7F are cross-sectional views sequentially illustrating a method for transferring a sheet according to an embodiment of the inventive concept.

Referring to FIG. 6, a method for transferring a sheet according to an embodiment of the inventive concept includes a process (S100) of continuously laminating two or more sheets on a table and a process (S200) of transferring a first sheet that is the uppermost sheet of the laminated sheets. The process (S200) of transferring the first sheet includes a process (S210) of adsorbing the first sheet via a sheet adsorbing part, a process (S220) of elevating the first sheet at a height (e.g., a predetermined height), and a process (S230) of separating a second sheet that is elevated together with the first sheet.

Figure 7A:
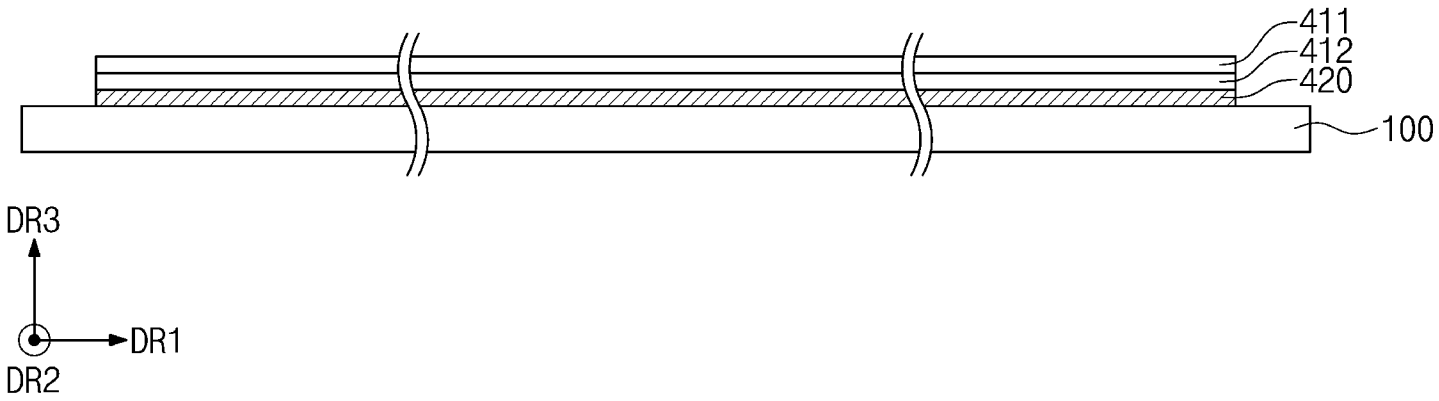
FIGS. 7A to 7F are cross-sectional views sequentially illustrating a method for transferring a sheet according to an embodiment of the inventive concept.

Referring to FIGS. 6 and 7A, the method for transferring the sheet according to an embodiment of the inventive concept includes the process (S100) of continuously laminating the two or more sheets on the table 100. The first sheet 411 and the second sheet 412 may be laminated on the table 100. The first sheet 411 and the second sheet 412 may be continuously laminated to come into contact with each other. Although the structure in which the first sheet 411 and the second sheet 412 are continuously laminated is illustrated in FIG. 7A, embodiments of the inventive concept are not limited thereto. For example, three or more sheets may be continuously laminated on the table 100.

Referring to FIG. 7A, the method for transferring the sheet according to an embodiment of the inventive concept may include a process of seating a metal stick 420 on the table 100 before the sheets are laminated. The metal stick 420 may be seated on the table 100 and then seated below the first sheet 411 and the second sheet 412, which are continuously laminated. Thus, the metal stick 420, the second sheet 412, and the first sheet 411 may be successively laminated on the table 100.

Referring to FIGS. 6 and 7B to 7D, the method for transferring the sheet according to an embodiment of the inventive concept includes the process (S200) of transferring the first sheet 411 that is the uppermost sheet of the laminated sheets.

Figure 7B:
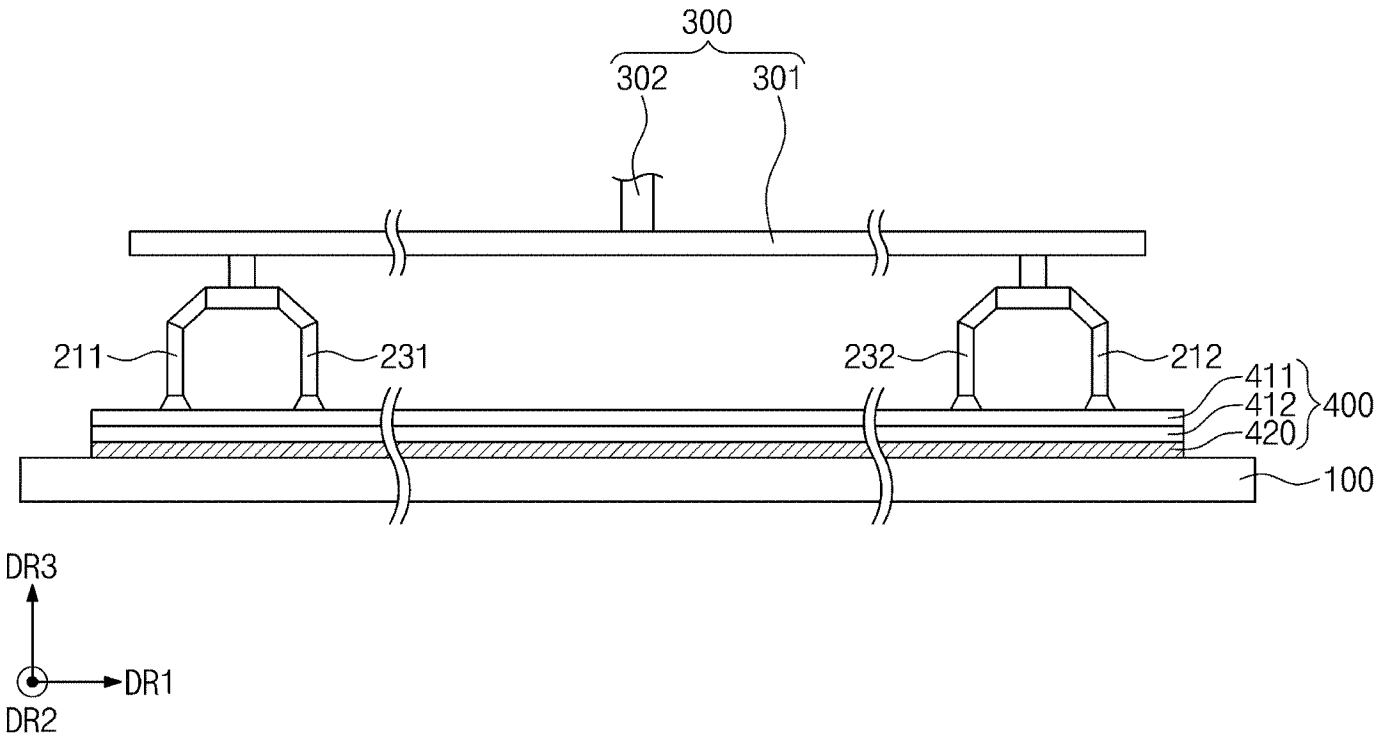

Referring to FIGS. 6 and 7B, the method for transferring the sheet according to an embodiment of the inventive concept includes the process (S210) of adsorbing the first sheet 411 that is the uppermost sheet of the laminated sheets. The first sheet 411 is adsorbed to the first sheet adsorbing part 211 and the second sheet adsorbing part 212 at a pressure (e.g., a predetermined pressure). The first sheet 411 is adsorbed to the first sheet adsorbing part 211 and the second sheet adsorbing part 212 at a first pressure. In an embodiment, the first pressure may be in a range from about 35 kpa to about 40 kpa.

Figure 7C:
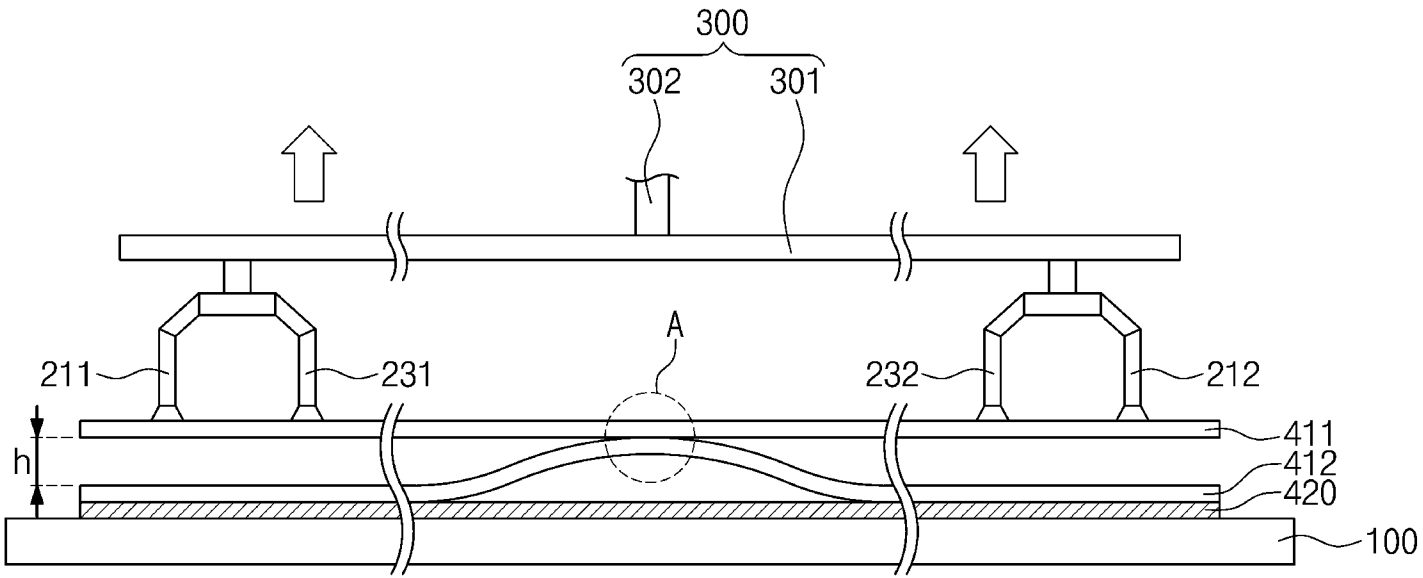

Referring to FIGS. 6 and 7C, the method for transferring the sheet according to an embodiment of the inventive concept includes the process (S220) of elevating the first sheet 411 at a height (e.g., a predetermined height) h. In the state in which the first sheet 411 is adsorbed to the first sheet adsorbing part 211 and the second sheet adsorbing part 212 at the first pressure, the first sheet 411 may ascend at the height h according to an operation of the elevation part 302 of the elevation unit 300.

As illustrated in FIG. 7C, when the first sheet 411 ascends at the height h, the second sheet 412 may ascend together with the ascending first sheet 411, as shown in a region A. In an embodiment, the second sheet 412 may be made of a same paper material as the first sheet 411. Thus, electrostatic attractive force may act between the first sheet 411 and the second sheet 412, which are continuously laminated. Thus, in the state in which the first sheet 411 is adsorbed to the first sheet adsorbing part 211 and the second sheet adsorbing part 212 at the first pressure, when the first sheet 411 ascends according to the operation of the elevation part 302, a portion of the second sheet 412 may ascend together with a bottom surface of the first sheet 411 by the electrostatic attractive force. As a result, the second sheet 412 may have a curved shape, as shown in the region A.

The method for transferring the sheet according to an embodiment of the inventive concept include a process (S230) of discharging air through the air discharge part that is disposed adjacent to the sheet adsorbing part so as to separate the second sheet 412 that ascends together with the first sheet 411. As the air is discharged through the air discharge part, external force due to the discharge of the air may act on the surface of the first sheet 411. As a result, the electrostatic attractive force acting between the first sheet 411 and the second sheet 412 may be removed, and, thus, the second sheet 412 ascending together with the first sheet 411 may be separated to descend. The process of discharging the air through the air discharge part to separate the second sheet 412 may start when the first sheet 411 ascends up to the height h. In an embodiment, the process of discharging the air through the air discharge part to separate the second sheet 412 may start when the first sheet 411 ascends at a height of about 20 mm to about 35 mm. The process (S230) of separating the second sheet 412 will be described in more detail with reference to FIGS. 8A to 9B.

Figure 7D:
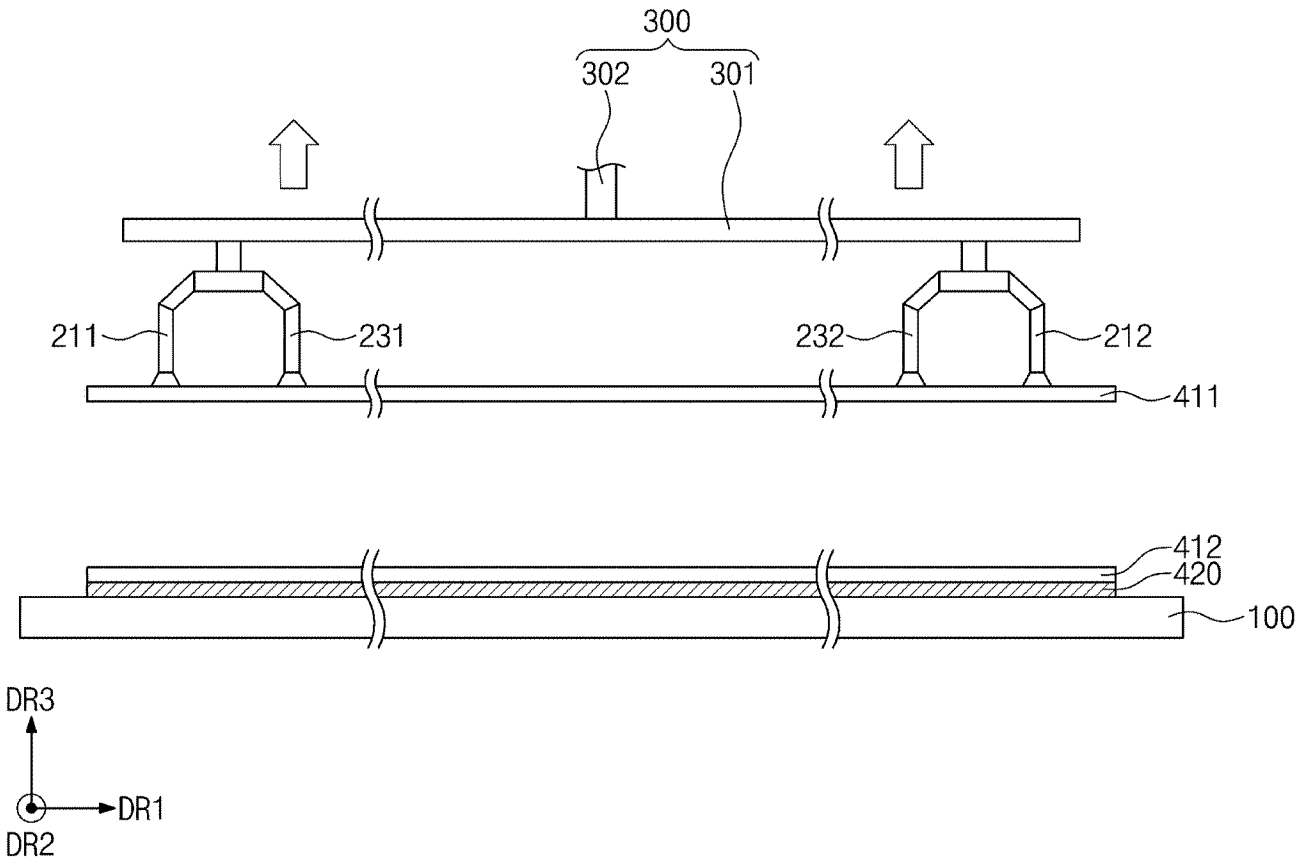

Referring to FIG. 7D, after the second sheet 412 ascending together with the first sheet 411 is separated, the first sheet 411 may additionally ascend via the elevation part 302 of the elevation unit 300. The first sheet 411 may ascend via the operation of the elevation part 302 and then be transferred to a different position.

Figure 7E:
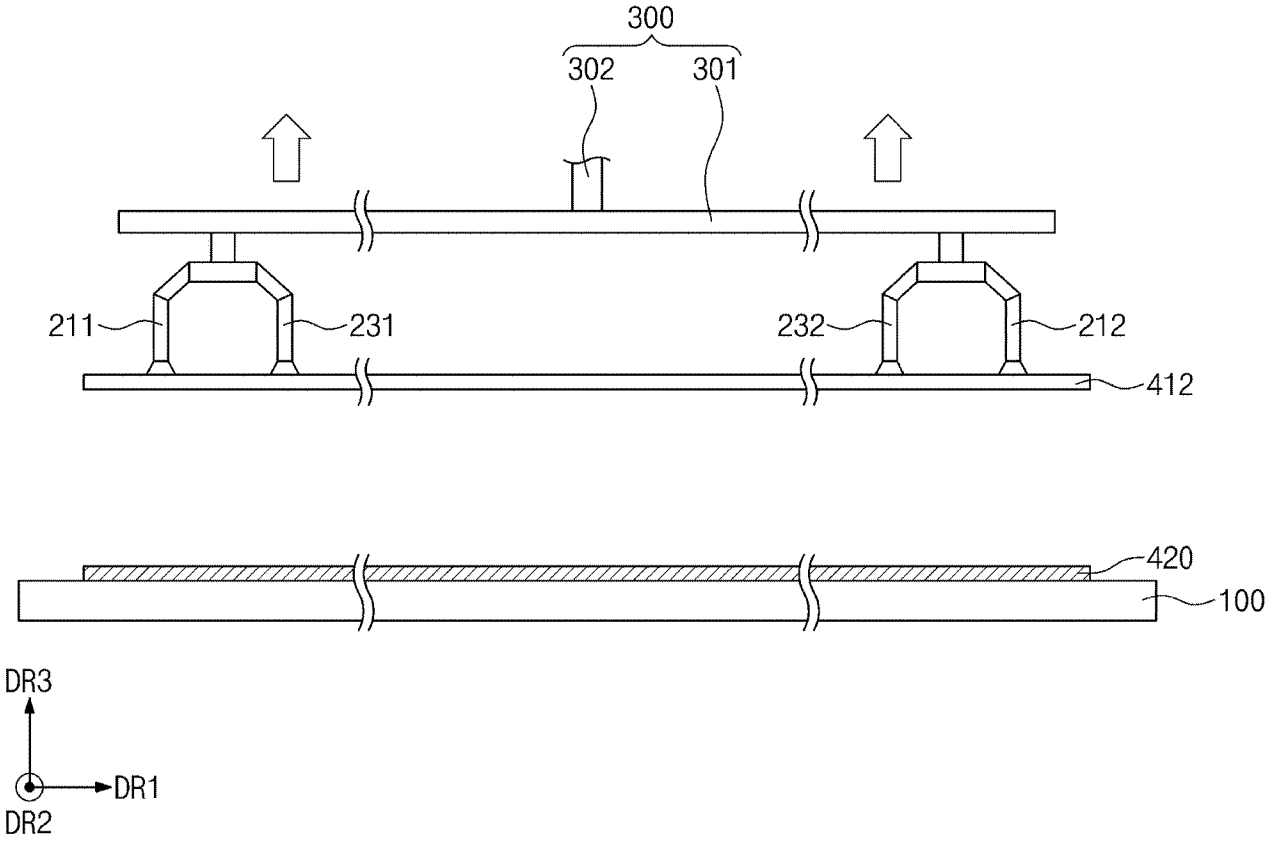
Figure 7F:
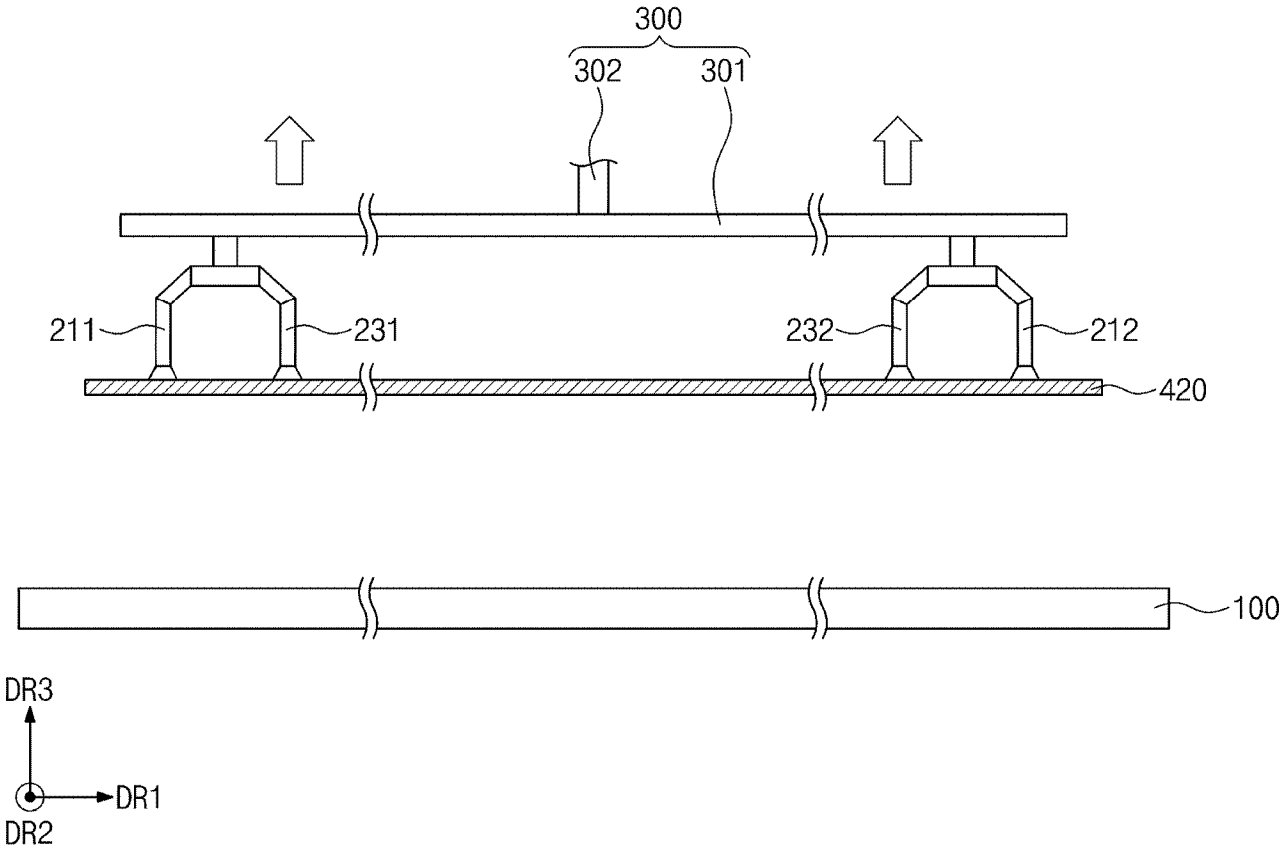

Referring to FIGS. 7E and 7F, the method for transferring the sheet according to an embodiment of the inventive concept may further include a process of transferring the second sheet 412 and a process of transferring the metal stick 420 after the first sheet is transferred.

As illustrated in FIG. 7E, the method for transferring the sheet according to an embodiment of the inventive concept may include the process of transferring the second sheet 412 by using the sheet adsorbing part, which operates in the process of transferring the first sheet, after the first sheet is transferred. The second sheet 412 may be adsorbed to the first sheet adsorbing part 211 and the second sheet adsorbing part 212 at a pressure (e.g., a predetermined pressure) and then be transferred. The second sheet 412 may be adsorbed to the first sheet adsorbing part 211 and the second sheet adsorbing part 212 at the first pressure that is applied to adsorb the first sheet. In an embodiment, the first pressure may be in a range from about 35 kpa to about 40 kpa.

As illustrated in FIG. 7F, the method for transferring the sheet according to an embodiment of the inventive concept may include the process of transferring the metal stick 420 after the second sheet is transferred. In an embodiment, the metal stick 420 may not be adsorbed by the sheet adsorbing part that operates in the process of transferring the first sheet and the process of transferring the second sheet, but may be adsorbed by the stick adsorbing part and then be transferred. The metal stick 520 may be adsorbed by the first stick adsorbing part 231 and the second stick adsorbing part 232, which are disposed on inner portions of the support part 301 rather than the first sheet adsorbing part 211 and the second adsorbing part 212, and then be transferred. The first stick adsorbing part 231 and the second stick adsorbing part 232 may adsorb the metal stick 420 at a second pressure. In an embodiment, the second pressure may be in a range from about 15 kpa to about 25 kpa.

Figure 8A:
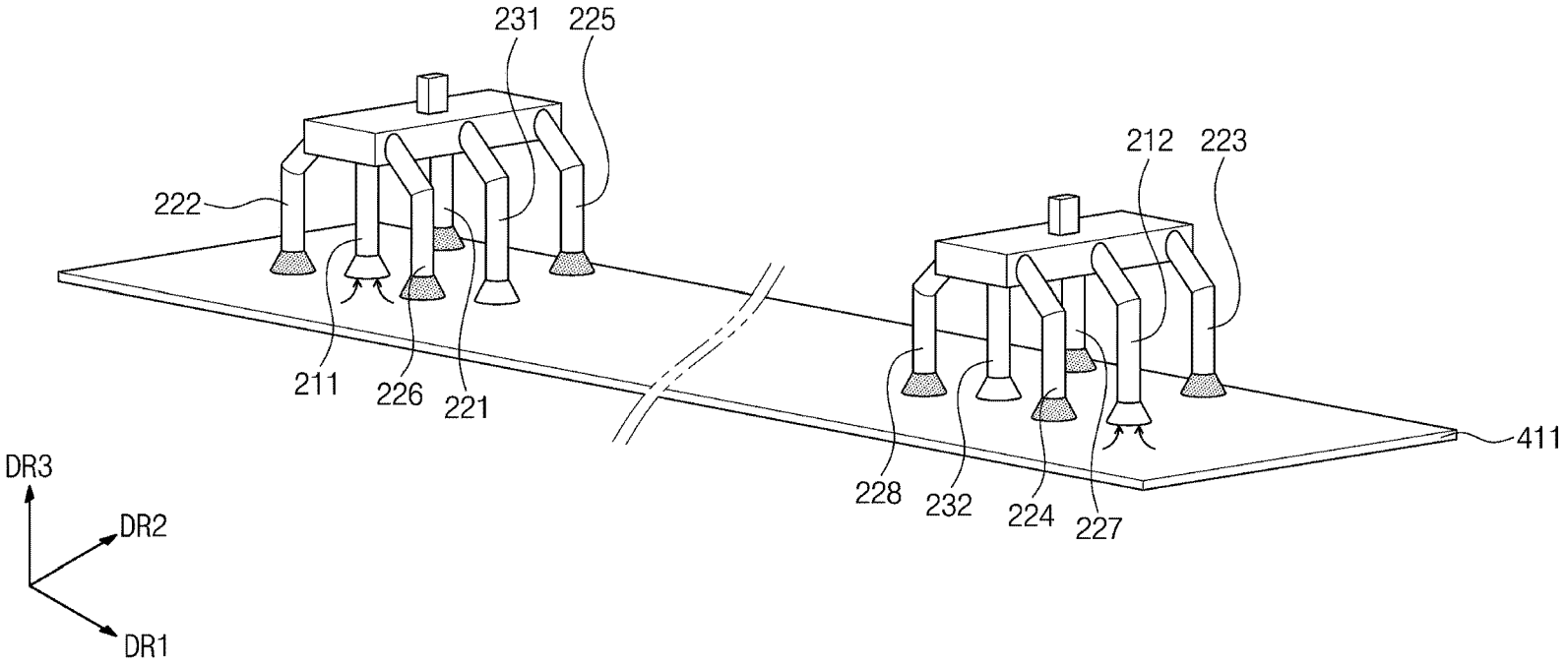
FIGS. 8A to 8C are perspective views illustrating a portion of the processes in the method for transferring a sheet according to an embodiment of the inventive concept.
Figure 8B:
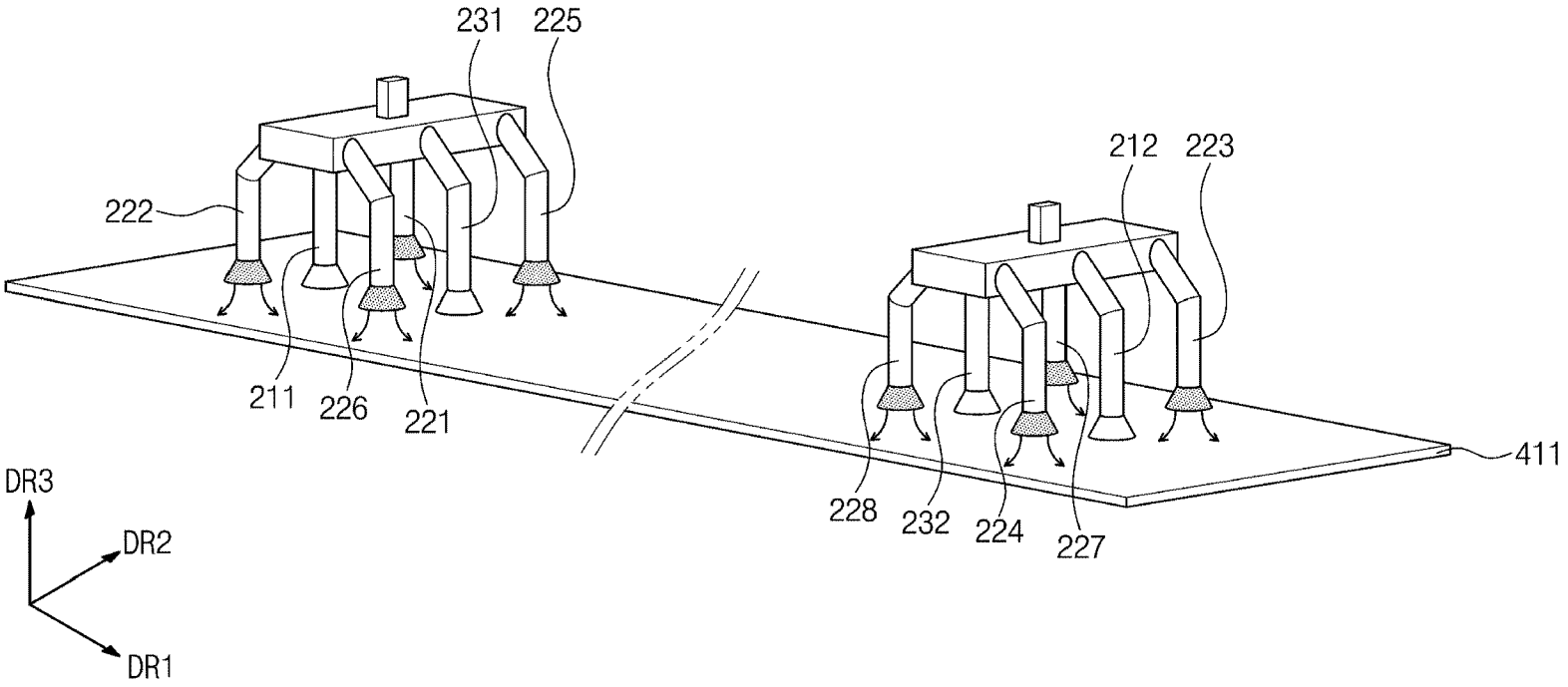
Figure 8C:
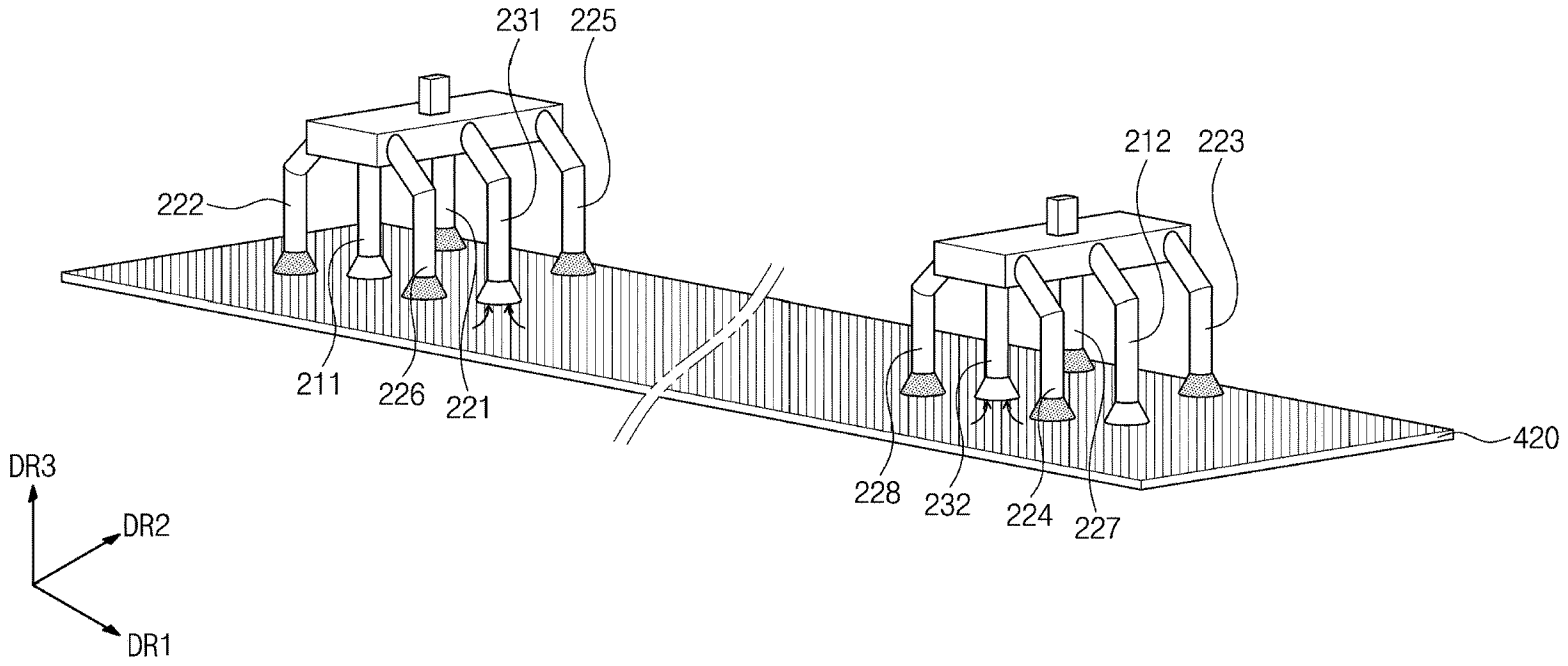

FIGS. 8A to 8C are perspective views illustrating a portion of the processes in the method for transferring the sheet according to an embodiment of the inventive concept. FIGS. 8A to 8C illustrate a process of adsorbing the transferred object through the sheet adsorbing part or the stick adsorbing part and discharging air to a surface of the transferred object through the air discharge part in the method for transferring the sheet according to an embodiment of the inventive concept. Herein, a portion of the process of transferring the first sheet 411 and the process of transferring the metal stick 420 in the method for transferring the sheet according to an embodiment of the inventive concept will be described in more detail with reference to FIGS. 8A to 8C.

Referring to FIG. 8A, in the process of transferring the first sheet 411 in the method for transferring the sheet according to an embodiment of the inventive concept, the first sheet 411 is adsorbed by the sheet adsorbing part. The sheet adsorbing part may include a first sheet adsorbing part 211 and a second sheet adsorbing part 212.

The first sheet adsorbing part 211 and the second sheet adsorbing part 212 may independently adsorb the first sheet 411 at the first pressure. In an embodiment, the first sheet adsorbing part 211 and the second sheet adsorbing part 212 may adsorb the first sheet 411 sheet at the same pressure. In an embodiment, the first sheet adsorbing part 211 and the second sheet adsorbing part 212 may adsorb the first sheet 411 sheet at a pressure of about 35 kpa to about 40 kpa.

In the process of adsorbing the first sheet 411, the stick adsorbing part may not operate. In an embodiment, in the process of adsorbing the first sheet 411, the adsorption of the first sheet 411 by using the first stick adsorbing part 231 and the second stick adsorbing part 232 at a separate pressure may not be performed, and the first sheet 411 may be adsorbed at the first pressure through only the first sheet adsorbing part 211 and the second sheet adsorbing part 212.

Although the adsorption of the first sheet 411 through the first sheet adsorbing part 211 and the second sheet adsorbing part 212 is illustrated in FIG. 8A, the same description may be applied to a case in which the second sheet (see reference numeral 412 of FIG. 7E) is adsorbed. That is, in the process of transferring the second sheet, the second sheet may be adsorbed at the same first pressure through the first sheet adsorbing part 211 and the second sheet adsorbing part 212. In an embodiment, in the process of adsorbing the second sheet, the first sheet adsorbing part 211 and the second sheet adsorbing part 212 may adsorb the second sheet at a pressure of about 35 kpa to about 40 kpa.

Referring to FIG. 8B, in the process of transferring the first sheet 411 in the method for transferring the sheet according to an embodiment of the inventive concept, air is discharged to the surface of the first sheet 411 by the air discharge part. As the air is discharged to the surface of the first sheet 411, the other transferred object ascending together with the first sheet 411 may be separated. In further detail, as the first sheet 411 is adsorbed by the sheet adsorbing part to ascend, when the second sheet disposed below the first sheet 411 ascends together with the first sheet 411 by the electrostatic attractive force, the air may be discharged to the surface of the first sheet 411 to apply vibration to the first sheet 411. Thus, the electrostatic attractive force between the first sheet 411 and the second sheet, which ascends together with the first sheet 411, may be removed to separate the second sheet. In an embodiment, the air discharged by the air discharge part may be compressed air.

In the process of transferring the first sheet 411 in the method for transferring the sheet according to an embodiment of the inventive concept, the air may be discharged to the surface of the first sheet 411 by a first air discharge part 221, a second air discharge part 222, a third air discharge part 223, and a fourth air discharge part 224. Also, in the process of transferring the first sheet 411, the air may be discharged to the surface of the first sheet 411 by an auxiliary air discharge part disposed adjacent to the stick adsorbing part. The auxiliary air discharge part may include a fifth air discharge part 215, a sixth air discharge part 216, a seventh air discharge part 217, and an eighth air discharge part 218.

In an embodiment, the air discharge part and the auxiliary air discharge part may operate in only the process of transferring the first sheet 411 to discharge the air to the surface of the first sheet 411, but may not operate in the process of transferring the second sheet and the process of transferring the metal stick. In an embodiment, in the process of transferring the second sheet and the process of transferring the metal stick, the first air discharge part 221 to the eighth air discharge part 228 may not discharge air to the surface of the second sheet and the metal stick.

Referring to FIG. 8C, in the process of transferring the metal stick 420 in the method for transferring the sheet according to an embodiment of the inventive concept, the metal stick 420 is adsorbed by a stick adsorbing part. The stick adsorbing part may include a first stick adsorbing part 231 and a second stick adsorbing part 232.

The first stick adsorbing part 231 and the second stick adsorbing part 232 may independently adsorb the metal stick 420 at the second pressure. The first stick adsorbing part 231 and the second stick adsorbing part 232 may adsorb the metal stick 420 at the same pressure. In an embodiment, the first stick adsorbing part 231 and the second stick adsorbing part 232 may adsorb the metal stick 420 at a pressure of about 15 kpa to about 25 kpa.

In an embodiment, in the process of adsorbing the metal stick 420, the sheet adsorbing part may not operate. In an embodiment, in the process of adsorbing the metal stick 420, the adsorption of the metal stick 420 by using the first sheet adsorbing part 211 and the second sheet adsorbing part 212 at a separate pressure may not be performed, and the metal stick 420 may be adsorbed at the second pressure through only the first stick adsorbing part 231 and the second stick adsorbing part 232.

In the method for transferring the two or more sheets that are continuously laminated, when the uppermost sheet is adsorbed by the sheet adsorbing part to ascend, the sheet disposed below the uppermost sheet may ascend together with the uppermost sheet by the electrostatic attractive force (see FIG. 7C). In detail, in the method for transferring the two or more sheets that are continuously laminated, as the two or more sheets are continuously laminated on the metal stick to protect the metal stick, when the uppermost sheet is adsorbed to ascend, a portion of the lower sheet made of the same material may ascend together by the electrostatic attractive force to cause bending of the lower sheet. When the bending of the lower sheet occurs, an additional process of realigning the misaligned sheets may be performed. Thus, it is difficult to perform the process of continuously transferring the sheets, and, also, the lower sheet may be bent to apply external force to the metal stick disposed below the lower sheet to cause bending or damage of the metal stick.

The method for transferring the sheet according to an embodiment of the inventive concept include a process of discharging the air to the surface of the ascending sheet through the air discharge part in the process of adsorbing the uppermost sheet to ascend to separate the lower sheet that ascends together with the uppermost sheet. Thus, a limitation that occurs when the lower sheet ascends together with the uppermost sheet may be prevented or substantially prevented. Also, in the method for transferring the sheet according to an embodiment of the inventive concept, the air discharge part may discharge the air to the surface of the adsorbed sheet without physically damaging holes to apply vibration to the sheet, thereby separating the lower sheet. Thus, since the physical damage of the hole does not occur on the transferred sheet, the sheet may be retransferred after being transferred and thus may be reused as the lamination sheet for protecting the metal stick.

Figure 9A:
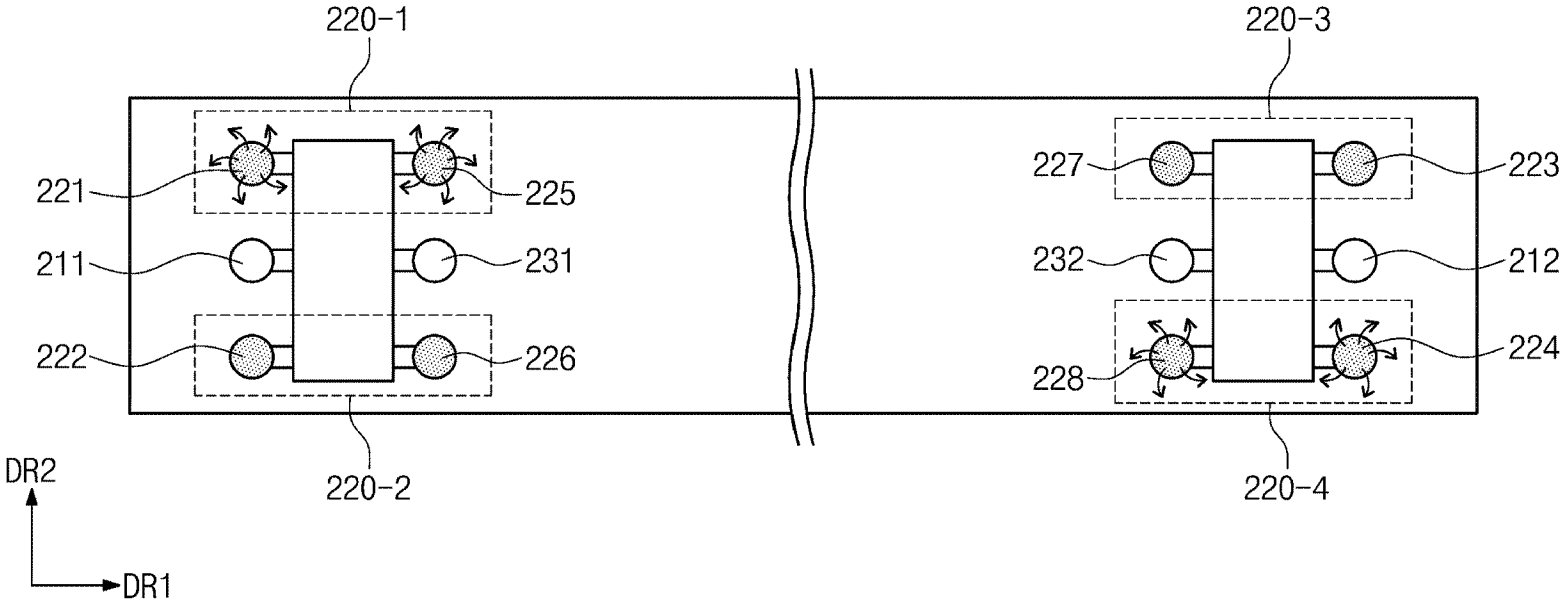
FIGS. 9A and 9B are plan views illustrating a state in which a portion of the processes is performed in the method for transferring the sheet when viewed from a lower side according to an embodiment of the inventive concept.
Figure 9B:
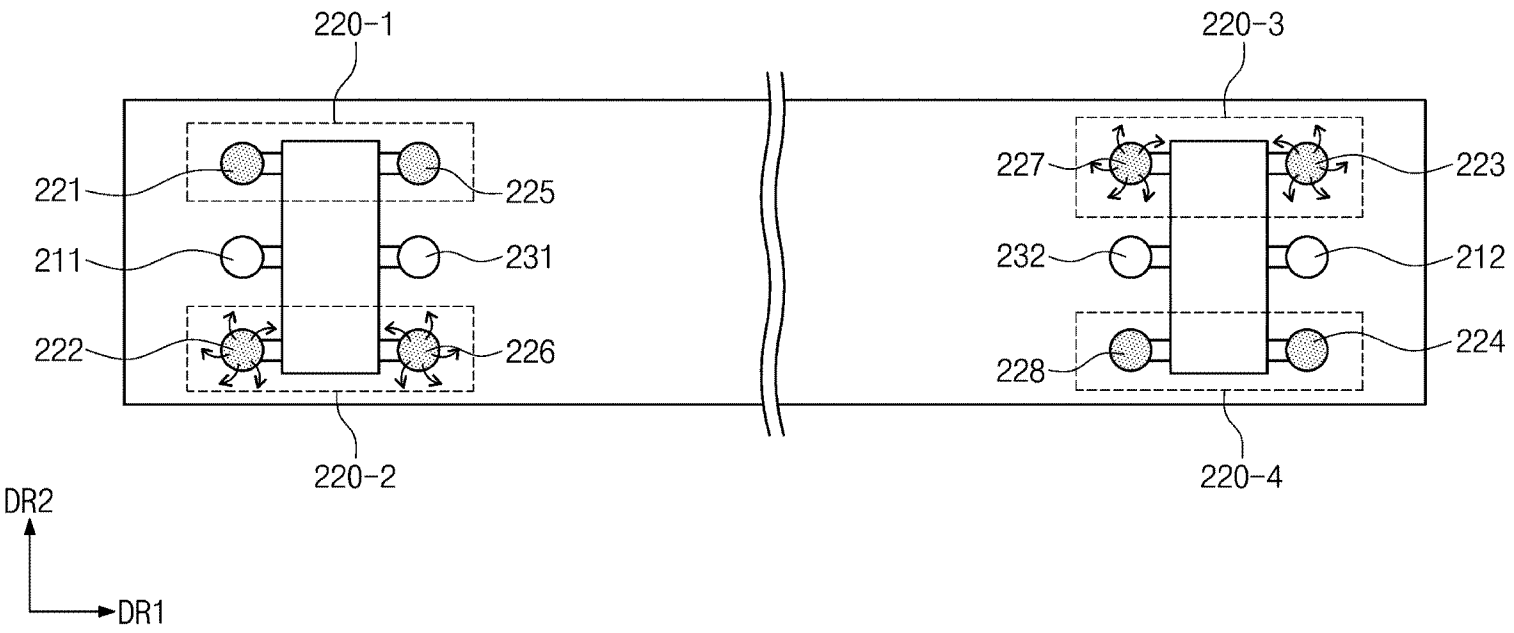

FIGS. 9A and 9B are plan views illustrating a state in which a portion of the processes is performed in the method for transferring the sheet when viewed from a lower side according to an embodiment of the inventive concept. FIGS. 9A and 9B illustrate plan views when viewed from a lower side in a process included in the processes of FIG. 8B. Herein, the process of discharging air through the air discharge part in the process of transferring the first sheet will be described in more detail with reference to FIGS. 9A and 9B.

Referring to FIGS. 9A and 9B, the air discharge part of the sheet transfer apparatus according to an embodiment of the inventive concept may include a first air discharge part 220-1 disposed adjacent to the first sheet adsorbing part 211 and the first stick adsorbing part 231, a second air discharge part 220-2 disposed adjacent to the first sheet adsorbing part 211 and the first stick adsorbing part 231 and disposed in parallel to the first air discharge part 220-1 in the second direction DR2, a third air discharge part 220-3 disposed adjacent to the second sheet adsorbing part 212 and the second stick adsorbing part 232 and disposed in parallel to the first air discharge part 220-1 in the first direction DR1, and a fourth air discharge part 220-4 disposed adjacent to the second sheet adsorbing part 212 and the second stick adsorbing part 232 and disposed in parallel to the second air discharge part 220-2 in the first direction DR1. The first air discharge part 220-1 may include the first air discharge part 221 and the fifth air discharge part 225. The second air discharge part 220-2 may include the second air discharge part 222 and the sixth air discharge part 226. The third air discharge part 220-3 may include the third air discharge part 223 and the seventh air discharge part 227. The fourth air discharge part 220-4 may include the fourth air discharge part 224 and the eighth air discharge part 228.

Referring to FIG. 9A, in an embodiment, in the process of discharging the air to the adsorbed sheet, the first air discharge part 220-1 and the fourth air discharge part 220-4 may operate at the same time. The first air discharge part 220-1 and the fourth air discharge part 220-4 may discharge the air to the adsorbed sheet at the same time. In an embodiment, when the air is discharged to the sheet by the first air discharge part 220-1 and the fourth air discharge part 220-4, the second air discharge part 220-2 and the third air discharge part 220-3 may not discharge the air.

Referring to FIG. 9B, in an embodiment, in the process of discharging the air to the adsorbed sheet, the second air discharge part 220-2 and the third air discharge part 220-3 may operate at the same time. The second air discharge part 220-2 and the third air discharge part 220-3 may discharge the air to the adsorbed sheet at the same time. In an embodiment, when the air is discharged to the sheet by the second air discharge part 220-2 and the third air discharge part 220-3, the first air discharge part 220-1 and the fourth air discharge part 220-4 may not discharge the air.

In an embodiment, the process of discharging the air through the first air discharge part 220-1 and the fourth air discharge part 220-4 of FIG. 9A and the process of discharging the air through the second air discharge part 220-2 and the third air discharge part 220-3 of FIG. 9B may be alternately repeatedly performed. In an embodiment, in the process of discharging the air to the adsorbed sheet, the air may be discharged through the second air discharge part 220-2 and the third air discharge part 220-3 after the air is discharged through the first air discharge part 220-1 and the fourth air discharge part 220-4, and, then, the air may be discharged through the first air discharge part 220-1 and the fourth air discharge part 220-4. In an embodiment, each of the process of discharging the air through the first air discharge part 220-1 and the fourth air discharge part 220-4 and the process of discharging the air through the second air discharge part 220-2 and the third air discharge part 220-3 may be performed for about 1 second to about 5 seconds, and, in an embodiment, the processes may be alternately repeatedly performed about 10 times to about 20 times. In an embodiment, each of the process of discharging the air through the first air discharge part 220-1 and the fourth air discharge part 220-4 and the process of discharging the air through the second air discharge part 220-2 and the third air discharge part 220-3 may be alternately repeatedly performed about 15 times at a time interval of about 1 second.

In the method for transferring the sheet according to an embodiment of the inventive concept, when the air is discharged to the sheet that is adsorbed to ascend, a process of discharging the air through the air discharge part that is disposed in a diagonal direction with respect to the sheet of the air discharge part may be alternately repeatedly performed. In further detail, as illustrated in FIGS. 9A and 9B, the first air discharge part 220-1 and the fourth air discharge part 220-4, which are disposed to be spaced apart from each other in a diagonal direction, may operate at the same time to discharge the air, and the second air discharge part 220-2 and the third air discharge part 220-3 may operate at the same time to discharge the air. In the method for transferring the sheet according to an embodiment of the inventive concept, the air may be discharged through the air discharge part that is disposed in the diagonal direction, and the process of discharging the air in the diagonal directions different from each other may be repeatedly performed to easily separate the lower sheet that ascends together with the adsorbed sheet that ascends.

In the sheet transfer apparatus according to embodiments of the inventive concept, the sheets may be continuously transferred without the occurrence of the defects of the sheets to be transferred.

In the method for transferring the sheet according to embodiments of the inventive concept, the sheets may be transferred through the continuous process without the occurrence of defects and damage to the object to be transferred during the transfer process.

It will be apparent to those skilled in the art that various modifications and variations can be made in the inventive concept. Thus, it will be apparent that the present disclosure covers modifications and variations of this invention within the scope of the appended claims and their equivalents.

What is claimed is:

1. A sheet transfer apparatus comprising:

a table on which two or more sheets, which are continuously laminated, are configured to be seated;

a sheet adsorbing part over the table to adsorb a first sheet, which is at an uppermost portion, of the two or more laminated sheets at a pressure;

an air discharge part over the table and adjacent to the sheet adsorbing part; and an elevation unit configured to vertically elevate the sheet adsorbing part and the air discharge part, wherein the elevation unit comprises:

a support part having a long side extending in a first direction and a short side extending in a second direction crossing the first direction; and an elevation part configured to vertically elevate the support part, wherein the air discharge part is configured to discharge air in a downward direction onto a surface of the first sheet adsorbed to the sheet adsorbing part.

2. The sheet transfer apparatus of claim 1, wherein the sheet adsorbing part comprises a first sheet adsorbing part and a second sheet adsorbing part, which are connected to the support part, spaced apart from each other in the first direction, and respectively arranged on outer portions of the support part in a long side direction.

3. The sheet transfer apparatus of claim 1, wherein a metal sheet is configured to be further seated on the table, and the metal sheet on the table, the second sheet on the metal sheet, and the first sheet on the second sheet are sequentially laminated.

4. The sheet transfer apparatus of claim 3, further comprising a metal sheet adsorbing part configured to adsorb the metal sheet and disposed on an inner portion of the support part in a long side direction.

5. The sheet transfer apparatus of claim 4, wherein the metal sheet adsorbing part comprises a first metal sheet adsorbing part and a second metal sheet adsorbing part, which are spaced apart from each other.

6. The sheet transfer apparatus of claim 5, further comprising an auxiliary air discharge part adjacent to the metal sheet adsorbing part, wherein the auxiliary air discharge part comprises:

fifth and sixth air discharge parts arranged in parallel with the first metal sheet adsorbing part therebetween in the second direction; and seventh and eighth air discharge parts arranged in parallel with the second metal sheet adsorbing part therebetween in the second direction.

7. The sheet transfer apparatus of claim 4, wherein the sheet adsorbing part and the metal sheet adsorbing part are spaced from each other by a distance of about 25 cm to about 30 cm.

8. The sheet transfer apparatus of claim 1, wherein the sheet adsorbing part and the air discharge part are spaced from each other by a distance of about 40 mm to about 60 mm.

9. A sheet transfer apparatus comprising:

a table on which two or more sheets, which are continuously laminated, are configured to be seated;

a sheet adsorbing part over the table to adsorb a first sheet, which is at an uppermost portion, of the two or more laminated sheets at a pressure; and an air discharge part over the table and adjacent to the sheet adsorbing part, wherein the air discharge part is configured to discharge air to a surface of the first sheet adsorbed to the sheet adsorbing part, the sheet transfer apparatus further comprising an elevation unit configured to vertically elevate the sheet adsorbing part and the air discharge part, wherein the elevation unit comprises:

a support part having a long side extending in a first direction and a short side extending in a second direction crossing the first direction; and an elevation part configured to vertically elevate the support part, wherein the sheet adsorbing part comprises a first sheet adsorbing part and a second sheet adsorbing part, which are connected to the support part, spaced apart from each other in the first direction, and respectively arranged on outer portions of the support part in a long side direction, and wherein the air discharge part comprises:

first and second air discharge parts arranged in parallel with the first sheet adsorbing part therebetween in the second direction; and third and fourth air discharge parts arranged in parallel with the second sheet adsorbing part therebetween in the second direction.

10. A method for transferring a sheet, the method comprising:

transferring a first sheet, which is at an uppermost portion, of two or more laminated sheets that are seated on a table, wherein the transferring of the first sheet comprises:

adsorbing the first sheet of the two or more laminated sheets at a first pressure through a sheet adsorbing part;

elevating the first sheet at a reference height; and discharging air in a downward direction onto an upper surface of the first sheet through an air discharge part arranged adjacent to the sheet adsorbing part to separate a second sheet of the two or more sheets that ascends together with the adsorbed first sheet.

11. The method of claim 10, further comprising seating a metal sheet, which is sequentially laminated with the second sheet and the first sheet, on the table.

12. The method of claim 10, wherein the separating of the second sheet is performed when the first sheet ascends to a height of about 20 mm to about 35 mm.

13. A method for transferring a sheet, the method comprising:

transferring a first sheet, which is at an uppermost portion, of two or more laminated sheets that are seated on a table, wherein the transferring of the first sheet comprises:

adsorbing the first sheet of the two or more laminated sheets at a first pressure through a sheet adsorbing part;

elevating the first sheet at a reference height; and discharging air to a surface of the first sheet through an air discharge part arranged adjacent to the sheet adsorbing part to separate a second sheet of the two or more sheets that ascends together with the adsorbed first sheet, the method further comprising seating a metal sheet, which is sequentially laminated with the second sheet and the first sheet, on the table, and the method further comprising, after the transferring of the first sheet:

adsorbing the second sheet at the first pressure through the sheet adsorbing part to elevate and transfer the second sheet; and adsorbing the metal sheet at a second pressure less than the first pressure through a metal sheet adsorbing part spaced apart from the sheet adsorbing part to elevate and transfer the metal sheet.

14. The method of claim 13, wherein the sheet adsorbing part comprises a first sheet adsorbing part and a second sheet adsorbing part, which are spaced apart from each other in a first direction, and the metal sheet adsorbing part comprises a first metal sheet adsorbing part and a second metal sheet adsorbing part, which are between the first sheet adsorbing part and the second sheet adsorbing part.

15. The method of claim 14, wherein the air discharge part comprises:

a first air discharge part adjacent to the first sheet adsorbing part and the first metal sheet adsorbing part;

a second air discharge part adjacent to the first sheet adsorbing part and the first metal sheet adsorbing part and in parallel to the first air discharge part in a second direction;

a third air discharge part adjacent to the second sheet adsorbing part and the second metal sheet adsorbing part and in parallel to the first air discharge part in the first direction; and a fourth air discharge part adjacent to the second sheet adsorbing part and the second metal sheet adsorbing part and in parallel to the second air discharge part in the first direction.

16. The method of claim 15, wherein the separating of the second sheet comprises:

discharging air through the first air discharge part and the fourth air discharge part; and discharging air through the second air discharge part and the third air discharge part, and the discharging of the air through the first air discharge part and the fourth air discharge part and the discharging of the air through the second air discharge part and the third air discharge part are alternately repeatedly performed.

17. The method of claim 16, wherein the discharging of the air through the first air discharge part and the fourth air discharge part and the discharging of the air through the second air discharge part and the third air discharge part are alternately repeatedly performed about 10 times to about 20 times.

* * * * *